US006439542B2

(12) United States Patent
Gjerde

(10) Patent No.: US 6,439,542 B2
(45) Date of Patent: Aug. 27, 2002

(54) MULTIPURPOSE TOOL

(76) Inventor: Cliff Gjerde, Box 369, Leask Saskatchewan (CA), S0K 1M0

( * ) Notice: Subject to any disclaimer, the term of this patent is extended or adjusted under 35 U.S.C. 154(b) by 0 days.

(21) Appl. No.: 09/793,885

(22) Filed: Feb. 28, 2001

(30) Foreign Application Priority Data

Mar. 23, 2000 (CA) ..... 2302072

(51) Int. Cl.[7] ..... B66F 3/00
(52) U.S. Cl. ..... 254/17; 254/131
(58) Field of Search ..... 254/17, 131, 25, 254/18, 21

(56) References Cited

U.S. PATENT DOCUMENTS 3,049,337 A * 8/1962 Griggs ..... 254/131
3,168,285 A * 2/1965 Russac et al. ..... 254/131
5,165,659 A 11/1992 L'Heureux
5,176,363 A 1/1993 Bowlin
5,447,289 A 9/1995 Callahan
5,642,591 A 7/1997 Eddie
5,855,358 A 1/1999 Witter

FOREIGN PATENT DOCUMENTS

CA 2200252 9/1997

* cited by examiner

*Primary Examiner*—Robert C. Watson
(74) *Attorney, Agent, or Firm*—Ryan W. Dupuis; Adrian D. Battison; Michael R. Williams

(57) ABSTRACT

A multipurpose tool is provided for use in levering materials relative to one another in the renovation and construction of building structures. The tool includes an elongate shaft having a gripping end and a working end. A pair of elongate blades are mounted spaced apart and perpendicularly to the shaft with the working end of the shaft therebetween. Each blade extends longitudinally from first penetrating end to a second engaging end in the form a steel plate which is oriented parallel to the shaft. A plurality of fulcrums are defined on a outer side of the blades opposite the gripping end of the shaft. An additional fulcrum is formed on the working end of the shaft between the blades.

17 Claims, 5 Drawing Sheets

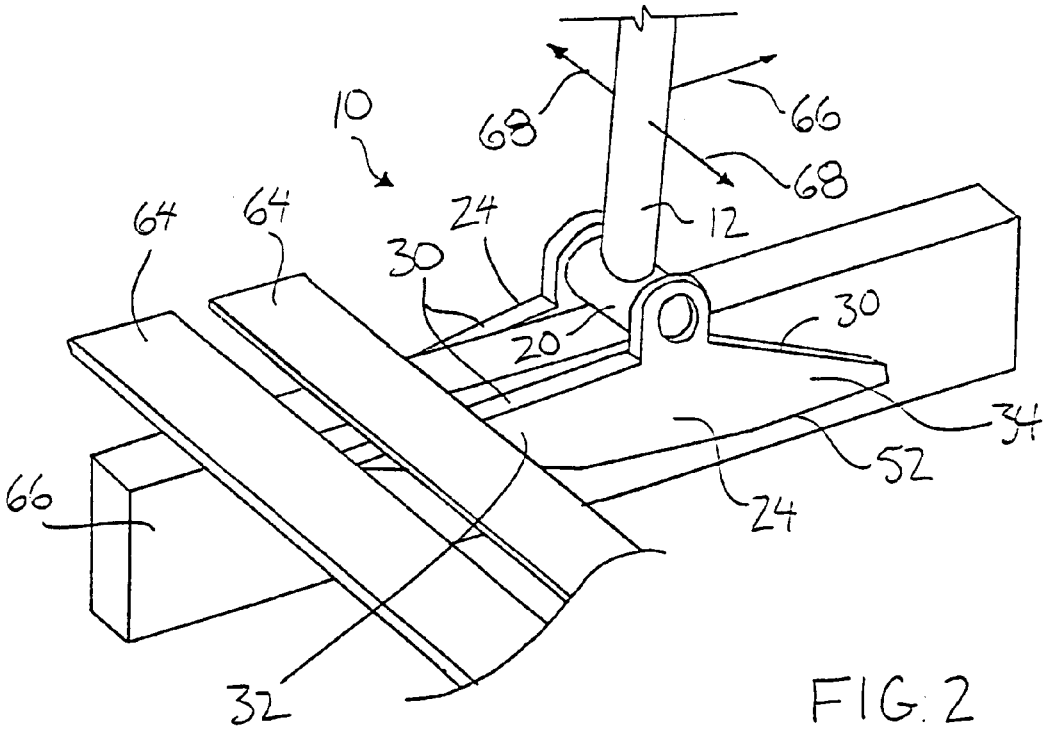
FIG. 2
FIG. 3
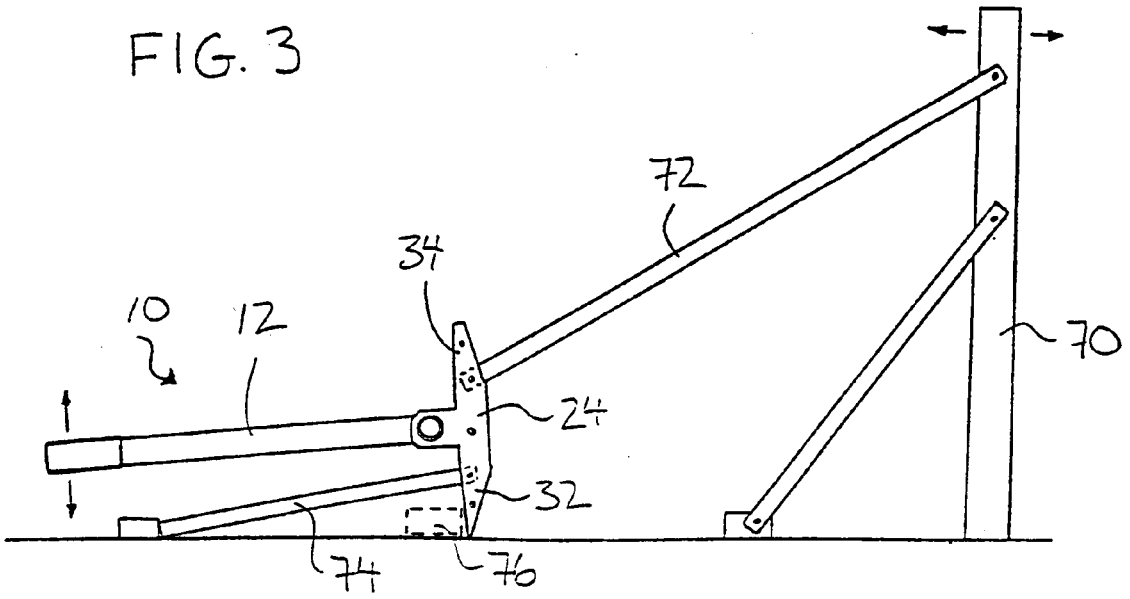

MULTIPURPOSE TOOL

FIELD OF THE INVENTION

This invention relates to a multipurpose tool and more particularly to a tool for use in levering materials relative to one another in the renovation and construction of building structures.

BACKGROUND

When renovating building structures, it is often desirable to take various structures apart, while salvaging as much material as possible for later reuse. This is typically accomplished using various pulling and prying tools, for example a crowbar or a nail puller. A known type of apparatus for removing surface materials from a structural member like a joist comprises an elongate shaft having a forked member at one end thereof. The fork is arranged to straddle the joist, while the shaft serves as a lever for pulling the surface materials from the joist with the fork.

An example of a known apparatus of this type includes U.S. Pat. No. 5,642,591 to Eddie. Eddie provides a multipurpose hand tool apparatus which is used for various tasks related to construction and renovation of building structures. The apparatus includes an elongate shaft having a fork mounted on each end thereof as well and a coupling member mounted centrally on the shaft for securing an end of a chain or a structural member thereto. The forks at each end of the shaft and the coupling spaced therebetween however result in tool which is awkward to handle and difficult to grasp. Furthermore, the penetrating members of the forks are poorly oriented for penetrating through surface materials for generating sufficient leverage force for use in pulling various structural members apart.

The present invention is concerned with certain improvements to multipurpose tools related to levering tools for the purposes of renovating building structures.

SUMMARY

According to one aspect of the present invention there is provided a multipurpose tool comprising:

an elongate shaft having a gripping end and a working end; and at least one elongate blade mounted transversely to the shaft on the working end thereof, the blade having a toe portion extending from the shaft towards a first penetrating end and a heel portion extending from the shaft opposite the toe portion towards a second engaging end of the blade, the blade having an outer side opposite the gripping end of the shaft wherein the outer side of the blade is formed to define at least one fulcrum located thereon between the first and second ends of the blade.

The blades are oriented on the working end of the shaft such that there is a heel portion opposite the toe portion which is useful for providing added leverage when the tool is used as a lever. A person may position the shaft in a generally upright orientation for inserting the toe portion of the blades beneath an object to be lifted. Pulling back on the shaft while stepping on the heel portion of the blades provides a stable lifting arrangement for pivoting the tool about the fulcrum with minimal effort.

According to a second aspect of the present invention there is provided a multipurpose tool comprising:

an elongate shaft having a gripping end and a working end; and a pair of elongate, spaced apart blades mounted transversely to the shaft on the working end thereof with the shaft therebetween, each blade comprising a plate member extending longitudinally from a first penetrating end to a second engaging end and being oriented such that the plate member lies parallel to the shaft with an outer side of the blade opposite the gripping end of the shaft;

wherein the working end of the shaft is formed to define a fulcrum located between the blades spaced between the first and second ends thereof.

The spaced apart arrangement of the pair of blades allows the blades to be straddled over a joist having surface materials supported thereon. The tool may thus be used to pull the surface materials from the joist by rocking the blades about a fulcrum located therebetween while moving the shaft in a front to back direction. The parallel arrangement of the plates of the blades however, further allows the blades to secure the joist therebetween in a stable arrangement for twisting the joist free by rocking the shaft side to side. Both actions can be accomplished by the working end of the shaft while a person using the tool grips the gripping end.

According to a further aspect of the present invention there is provided a multipurpose tool comprising:

an elongate shaft having a gripping end and a working end; and at least one elongate blade mounted transversely to the shaft on the working end thereof and extending longitudinally from a first penetrating end to a second engaging end of the blade, the blade having an outer side opposite the gripping end of the shaft wherein the outer side of the blade comprises a plurality of substantially flat surfaces located sequentially along the blade with adjacent ones of the surfaces at an oblique angle to one another such that a fulcrum is defined at an intersection of each pair of adjacent surfaces.

The use of multiple fulcrum points at fixed positions along the outer side of the blades locates the fulcrum as close as possible to first penetrating end of the blades during initial stages of the lift and then gradually displaced the fulcrum towards the second end of the blades as an object engaged thereon is lifted. At each stage of the lift, the fulcrum is held as close as possible to the object until the blades have been sufficiently pivoted so as to provide a gradual lift at a minimal stress to the person using the tool.

The first penetrating end is preferably tapered towards a cutting edge wherein the cutting edge is located in a plane which lies perpendicularly to the shaft. The orientation of the cutting edge assists the blades in being penetrated into a supporting surface as the tool can be operated in an axe-like manner. Orientation of the shaft perpendicularly to the blade further assists the penetration of the blades when used in a chopping action.

The second engaging end is preferably tapered towards a blunt end face which substantially parallel to the shaft. The blunt end face acts as a hammer for use in breaking up materials or for assisting in penetrating a member into a supporting surface.

When there is provided a plurality of fulcrums spaced longitudinally along the outer side of the blade between the first and second ends of the blade, the outer side of the blade preferably comprises a plurality of substantially flat surfaces located sequentially along the blade with adjacent ones of the surfaces at an oblique angle to one another such that a fulcrum is defined at an intersection of each pair of adjacent surfaces.

There may be provided a pair of blades mounted parallel and spaced apart on the working end of the shaft, each blade having a first penetrating end and a second engaging end.

Each blade preferably comprises a plate member which is parallel to the shaft. The pair of blades is thus able to secure a joist or similar structural member therebetween for twisting the member free or for placing the member during construction.

When using a pair of blades, a fulcrum is preferably located between the blades, spaced inwardly from an outer side of the blades with an outer bottom face of the fulcrum located between the blades being spaced outwardly from and below an inner top side of each blade.

There may be provided a plurality of longitudinally spaced apertures located in each blade, the apertures in one of the blades being aligned with corresponding apertures in the other blade. The apertures allow additional materials to be secured to the blades for added leverage or for using the tool in positioning structural members during construction.

The shaft is preferably mounted between the plates such that an inner side of each blade defines a shoulder adjacent a corresponding side of the shaft. The shoulder can thus be used to support structural members thereon with the tool being supported in a free standing position. Pivotal movement of the tool about on the fulcrums will effectively raise the structural member supported thereon for assisting in placing materials during construction.

A width of the penetrating end of each blade is preferably significantly less than a spacing between the pair of blades. When used in a chopping action the overall width of the blade penetration into a supporting surface is thus much greater than the width of each individual blade for minimising resistance to blade penetration.

The fulcrum located between the blades may comprise a drum having an axis which lies perpendicularly to the shaft such that an outer face of the drum defines the fulcrum. The drum is preferably a tubular member having an opening at each end thereof defining a passage therethrough. The drum may thus also be used for receiving elongate materials, for example a bar, therethrough such that the material can be bent as desired by pivoting the tool laterally.

There may be provided flange member extending laterally outward from a side of one blade, the flange member having at least one notch therein for use as a nail puller.

There may further be provided a serrated portion on an inner side of each blade, defining a gripping portion of each blade.

BRIEF DESCRIPTION OF THE DRAWINGS

In the accompanying drawings, which illustrate exemplary embodiments of the present invention:

FIG. 2 is an isometric view of the tool of FIG. 1 shown in use for removing planks from a joist.

FIG. 3 is a side elevational view of the tool of FIG. 1 shown in a leverage position for levelling a wall.

DETAILED DESCRIPTION

Figure 1:
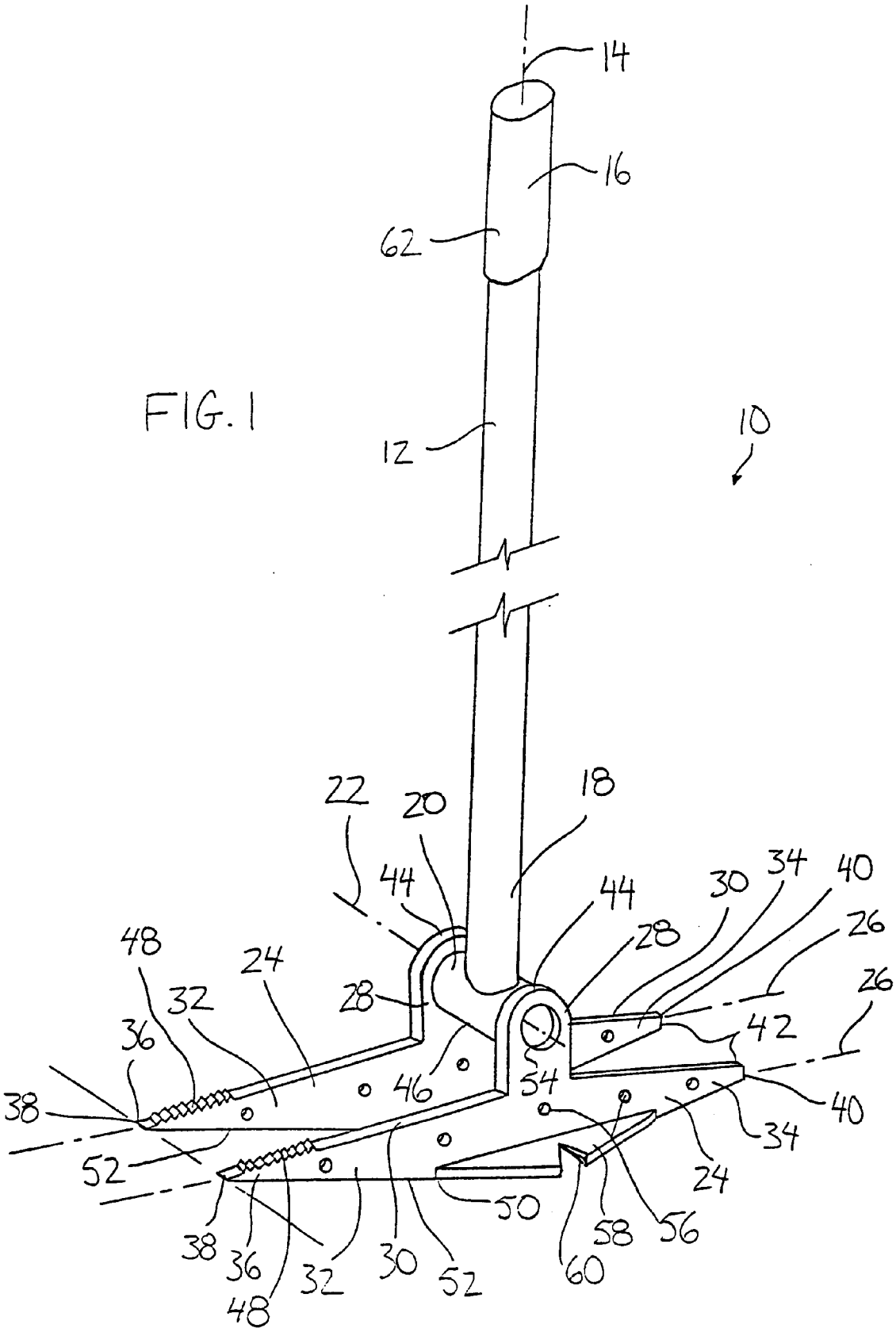
FIG. 1 is an isometric view of the tool according to the present invention.

Referring to the accompanying drawings, there is illustrated a multipurpose tool generally indicated by reference numeral 10. The tool 10 is generally for use in renovation and construction including pulling and prying apart of existing structures as well as assisting in placing an aligning new structural members.

The tool 10 includes an elongate shaft 12 formed of tubular steel and having a longitudinal axis 14 extending between a gripping end 16 and a working end 18 of the shaft. A hollow cylindrical drum 20 formed of steel is mounted on the working end of the shaft such that an axis 22 of the drum lies perpendicularly to the longitudinal axis 14 of the shaft.

A pair of blades 24 are mounted on respective ends of the drum 20 wherein each blade comprises an elongate member having a longitudinal axis 26 which lies perpendicularly to both the axis 14 of the shaft and the drum axis 22. Each blade 24 comprises a plate member of steel which is oriented parallel to the shaft and spaced from the opposing blade. A mounting portion 28 along an inner side 30 of each blade mounts the corresponding blade on one end of the drum 20. The mounting portion 28 is located centrally on each blade such that a toe portion 32 of the blade is defined to extend from the shaft in a first direction while a heel portion 34 of the blade is defined to extend in a second direction opposite the toe portion. The toe portion 32 of each blade is tapered toward a first penetrating end 36 defining a cutting edge 38 thereof. The cutting edges 38 of both blades are located within a plane which lies perpendicularly to the shaft. The width of each cutting edge 38 is significantly less than a corresponding spacing between the blades such that there is minimal resistance to penetration of the blades into an engaging surface.

The heel portion 34 of each blade is tapered towards a second engaging end 40 of the blade which comprises a blunt end face 42 which lies substantially parallel to the shaft.

The drum 20 and mounting portions 28 of the blade are arranged such that the plates are spaced laterally outward thus defining a pair of shoulders 44 for supporting material thereon. The shoulders 44 include an top portion of the outer drum surface which is flush with the inner top side of each mounting portion. The drum is located by the mounting portions such that the inner top side 30 of both the heel and toe portions of each blade are substantially coplanar and flush with an outer bottom side 46 of the drum. A portion of each inner side 30 along the toe portion 32 of each blade is serrated to define a gripping portion 48.

A plurality of fulcrum points 50 are longitudinally spaced along an outer side 52 of each blade such that the fulcrum points of one blade correspond in location to the fulcrum points of the opposing blade. The outer side 52 of each blade comprises a set of three flat surfaces sequentially located along the blade at varying relative angles therebetween such that a fulcrum point 50 is defined at an intersection of each pair of adjacent surfaces. A central one of the surfaces is substantially perpendicular to the shaft such that the tool may be self supported thereon on a supporting surface. The flat surfaces along the respective outer sides of the blades are arranged such that adjacent ones are at an oblique angle to one another thus defining the fulcrums therebetween.

A circular opening 54 is located within each mounting portion 28 in alignment with the hollow interior of the drum 20 such that a cylindrical passage is defined therethrough. Furthermore a plurality of longitudinally spaced apertures 56 are located within each blade member such that the apertures of one blade are aligned with corresponding apertures in the opposing blade. The apertures 56 are arranged to receive a fastener such as a nail therethrough for securing materials to the blades.

A nail puller 58 is provided in the form of a flange mounted on a side of one of the blades to extend laterally outward therefrom. A notch 60 is provided in the flange for securing the head of a fastener such as a nail therein to pull the nail from the materials by gripping the shaft and pulling in a conventional manner. The gripping end 16 of the shaft includes a gripped handle 62 for comfortably gripping the handle with a person's hand.

The tool 10 is particularly useful as a lever for lifting materials from the ground. The shaft is approximately 32 inches long to provide sufficient leverage. The inner top sides 30 of both the toe and heel portions of the blades are sloped at approximately 8 degrees from the horizontal axis 26 of the blades. The outer bottom side 52 of both the toe and heel portions of the blades is sloped at approximately 11 degrees from the axis 26 of the blades. The tool is thus well suited for inserting the cutting edge under a material to be lifted such that gripping the shaft and rotating about the drum axis 22 while stepping on the heel portion of the blades will lift the cutting edge 38 of each blade upwardly from the ground and accordingly lift the material supported thereon. Once in a lifted position, a person is free to use their hands while stepping on the heel portion such that the material remains lifted.

The perpendicular arrangement of the blades also makes the tool suitable for chopping in an axe like manner for penetrating through surface materials when renovating. The tool can thus be used as a pick axe for penetrating through various materials. In one example of use as an axe, the tool can be used to chop and split wood. The narrow cutting edges of the blades allow the blades to be easily penetrated into the wood, while the wedge shape of the respective toe portions of the blades acts to split the wood and the blades are inserted therein.

The spaced apart orientation of the cutting edges further permits the tool to grip an object such as a stake from opposing sides to pull the stake from the ground. The cutting edges are driven into the stake with the blades being oriented substantially flush along the ground such that by pulling back on the shaft the blades act as a lever as described above.

As shown in FIG. 2, the tool may be used to pry surface materials 64 from a joist 66. The tool is positioned such that each blade 24 lies adjacent one side of the joist while the drum 20 is supported on a top side of the joist and acts as a fulcrum. By positioning the toe portions beneath the surface material 64 and pulling in a rearward direction indicated by arrow 66 the blades will lift the surface material from the joist. Alternatively by displacing the shaft in a side to side orientation indicated by arrows 68 the tool may be used to twist the joist 66 to either break the joist free when renovating or to align the joist when constructing.

The tool 10 is also particularly useful for aligning structural members such as a wall 70 as shown in FIG. 3. The blades 24 thus act as part of a linkage while the shaft 12 forms a control handle for actuating the linkage. The linkage may be assembled by mounting a first link 72 in the form of scrap materials by pivotally mounting one end of the first link between a pair of corresponding apertures 56 in the heel portion of the blades and by pivotally mounting an opposing end of the first link on the wall 70 spaced upwardly from the ground. The tool may thus be anchored to the ground by a second link 74 pivotally mounted at one end on the apertures 56 in the toe portion of the blades and engaged on the ground at the other end. Alternatively a fixed mounting block 76 may be mounted on the ground such that the toe portion of the tool provides a leverage against the block.

Figure 4A:
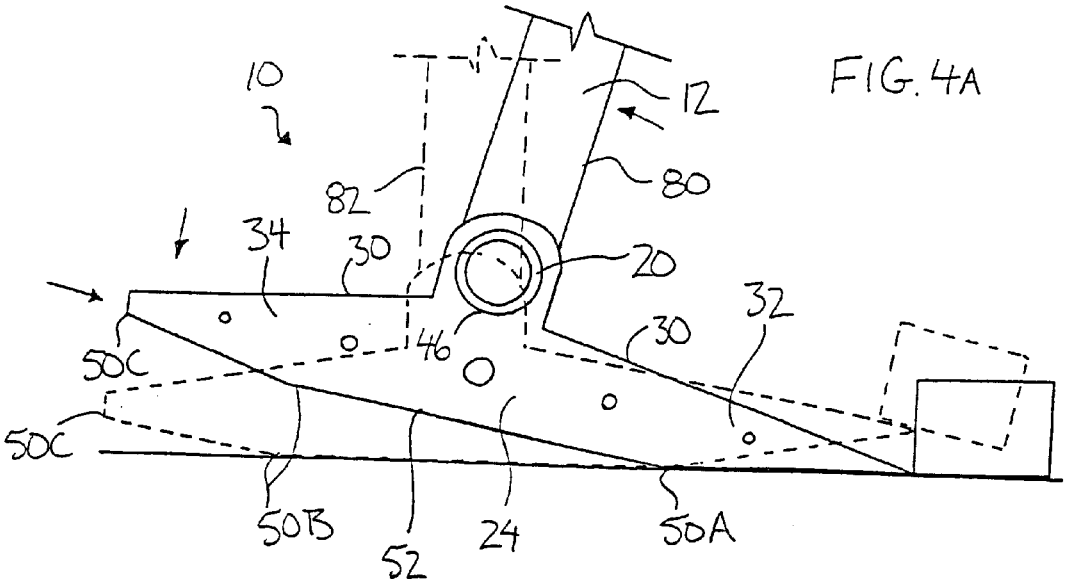
FIGS. 4A and 4B are respective side elevational views of the tool of FIG. 1 shown in various lifting positions using different fulcrum points.

As shown in FIG. 4, the outer sides 52 of the blades form a graduated fulcrum as described above. The position of the drum, the slopes of the inner and outer sides of the blades and the location of the fulcrum points 50 work together to create a stable and gradually less stressful lift. Each fulcrum point corresponds to a different leverage position starting with the most aggressive lift position 80 shown in FIG. 4A.

In the first leverage position 80 shown in FIG. 4A, by kicking on the drum or the working end of the shaft, the cutting edge is inserted under the material to be lifted and point 50A on the outer sides of the blades act as the fulcrum point. Stepping on the heel portion and pulling back on the shaft will thus rotate the blades into a second leverage position indicated by reference numeral 82 of FIGS. 4A and 4B.

Once in the second position, the material will be lifted upwardly from the ground with the cutting edge while the fulcrum point is relocated to point 50B on the outer sides of the blades. The blades may further be engaged under the material by kicking the drum or the working end of the shaft such that continued stepping action on the heel portion of the blades and continued pulling action on the shaft will further raise the material from the ground. Fulcrum point 50B corresponds to a less stressful lifting point.

Figure 4B:
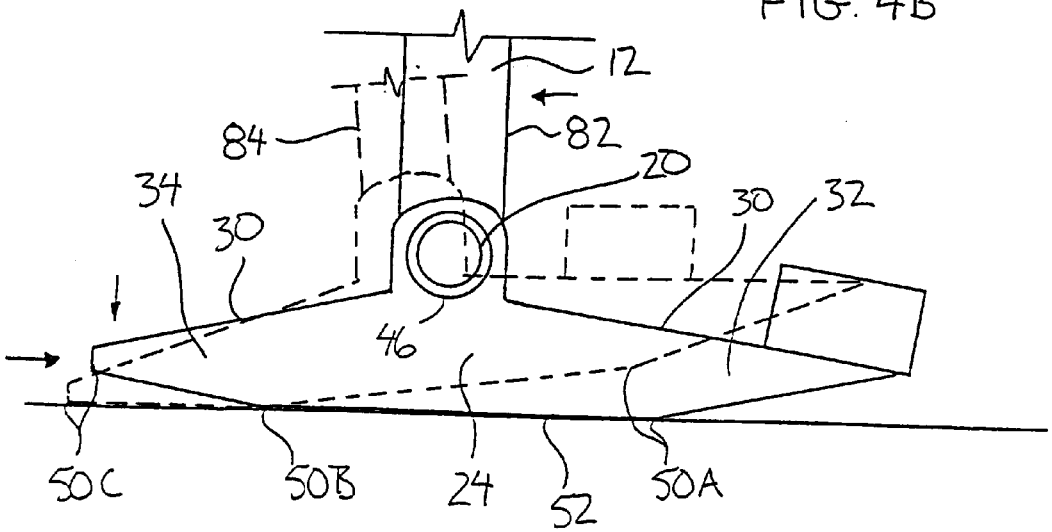

The tool may then be pivoted into a third leverage position indicated by reference numeral 84 as shown in FIG. 4B. The fulcrum point is thus relocated to point 50C on the outer sides of the blades to provide less stress to continued lifting of the material from the ground.

The tool 10 is extremely versatile and designed for a plurality of uses. The cutting edges 38 are particularly useful for scribing while the blunt end faces form a useful hammer-like tool for breaking up materials. The sides of the blades form a rigid face for engaging materials such as stakes to pound them into the ground. The flat portion of the outer sides of each blade spaced between the toe and heel portion allows the tool to be self supported and free standing on a supporting surface such as the ground. The benefits of the multiple fulcrum points as well as the orientation of the blades, can also be realised when using only a single blade in further embodiments.

Additional uses of the device include chopping, prying to separate materials, stripping, lifting, scraping, bending, twisting, pounding, ramming and pulling apart structures.

The tool is useful for bending reinforcement bars for concrete and the like, for example light bar No. 10 or bar having an outer diameter of approximately ⅜ of an inch. In order to bend elongate materials such as the reinforcement bars, an end of the material may be inserted through the cylindrical opening of the drum 20 or between the blades when the blades are positioned at an incline with one blade slightly above the other. Subsequently pulling the shaft 12 in a lateral direction towards the elongate material will bend the elongate material secured on the working end of the shaft.

The apertures 56 in the blades are additionally useful for securing additional members to the blades for added leveraging surfaces.

The shoulders 44 may also be use to support materials thereon for lifting the materials when the tool is pivoted about any one of its multiple fulcrum points. In a further example of lifting, the tool 10 may be used as a drywall kicker.

Figure 5:
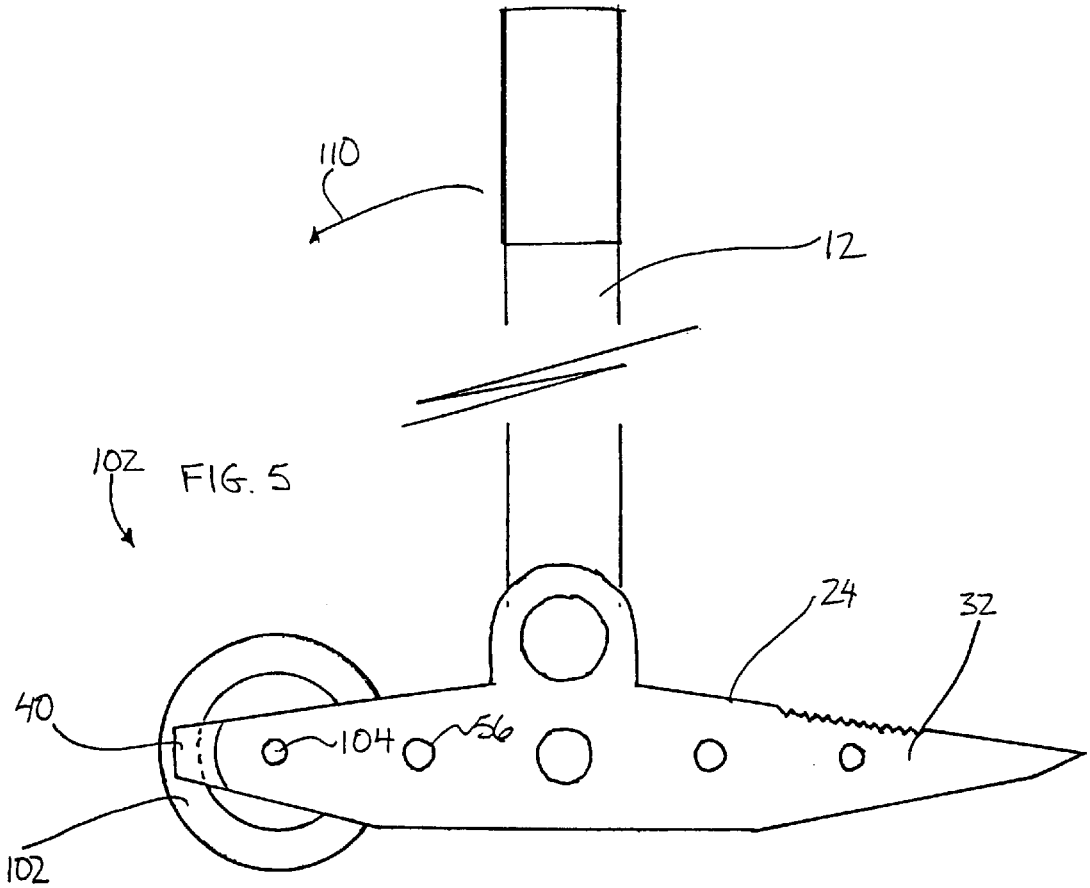
FIG. 5 is a side elevational view of the tool with an auxiliary attachment mounted thereon.
Figure 6:
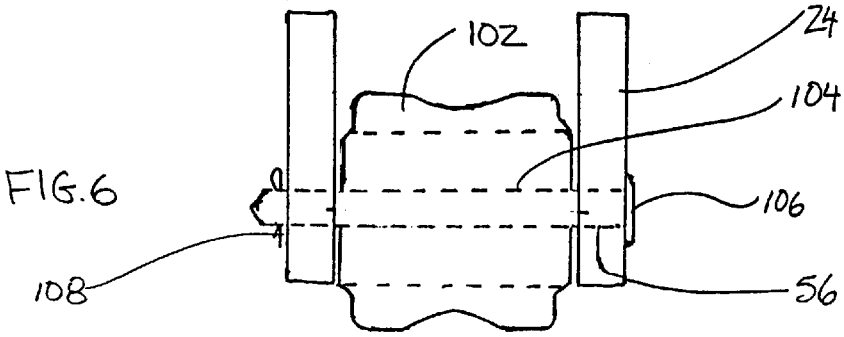
FIG. 6 is an end elevational view of the blade portion of the tool with the attachment of FIG. 5 mounted thereon.

As illustrated in FIGS. 5 and 6, a wheel attachment 100 is arranged to be mounted between the blades 24 of the tool. The wheel attachment includes a wheel 102 which is supported for rotation on a mounting pin 104 extending through a co-operating pair of the apertures 56 in the blades 24. The mounting pin 104 supports the wheel thereon for rotation about a laterally extending wheel axis which extends in longitudinal of the pin. The mounting pin 104 includes a head 106 formed at one end thereof of a releasable locking pin 108 secured through an opposing end such that removal of the locking pin 108 permits the mounting pin and wheel 102 to be selectively detached from the blades.

The diameter of the wheel 102 is greater than the height of the blades 24 such that the periphery of the wheel 102 extends past both the top and bottom sides of the blades 24. Mounting the wheel 102 and mounting pin 104 through a rearwardmost pair of the apertures 56 in the blades arranges the periphery of the wheel 102 to also extend rearwardly past the second end 40 of the blades.

Using the wheel attachment 100, objects which are lifted onto the toe portion 32 of the blades, can be supported for rolling movement across the ground on the wheel 102 by pulling the shaft 12 rearwardly in the direction indicated by reference numeral 110 in FIG. 5. The wheel can thus be used for moving heavy objects or for aligning the base of a wall, for example, when the wall is supported on the toe portion 32 of the blades.

Figure 7:
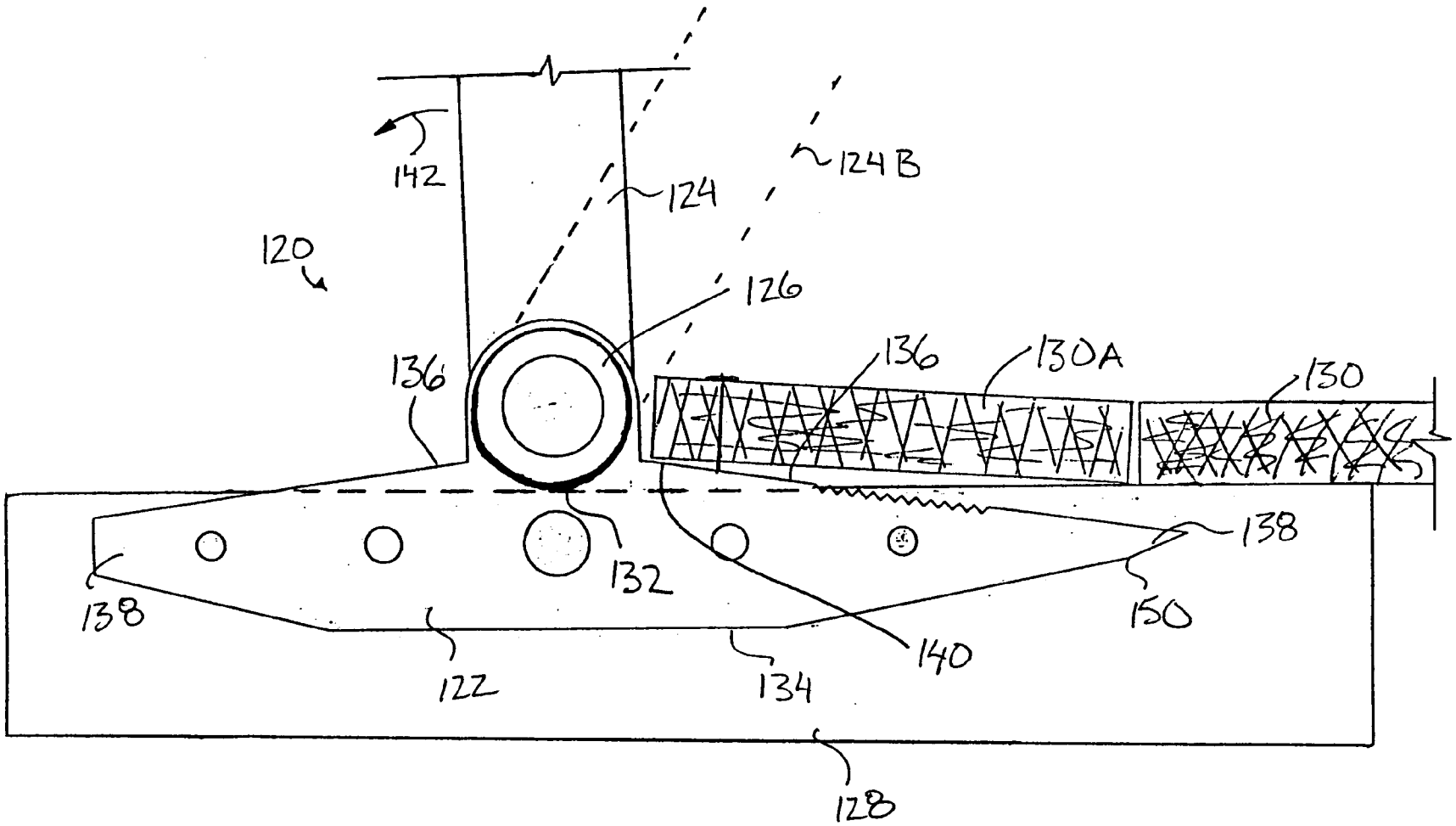
FIG. 7 is a side elevational view of a further embodiment.

As illustrated in FIG. 7 a further embodiment of the tool is generally indicated by reference numeral 120. The tool 120 is similar to the tool 10 described above having a pair of parallel and spaced apart blades 122 mounted on a working end of a shaft 124. A drum 126 mounts between the blades for acting as a fulcrum when the blades straddle a board 128 as described above for removing planks 130 and the like from the board 128. The bottom outer surface 132 of the drum 126 is spaced inwardly from and above the bottom outer side 134 of the blades 122. The bottom outer surface 132 of the drum 126 is also arranged to be spaced outwardly from and below the inner top side 136 of the blades 122 adjacent the shaft, with the inner top side 136 of the blades 122 tapering downward and outward from the shaft to respective ends 138 of the blades which are spaced below the bottom outer surface 132 of the drum.

In this arrangement, when straddling a board to remove planks therefrom as illustrated in FIG. 7, the drum may be positioned directly adjacent a first plank 130A to be removed with an inner end 140 of the inner top side 136 of the blades directly adjacent the drum in contact with a front edge of the plank 130A by leaning the shaft forwardly towards the planks as indicated in dotted line at 124B. By pulling the shaft in the direction 142, the inner end 140 directly adjacent the drum contacts the plank 130A first, providing greater leverage due to the shortened distance between the fulcrum and the plank to be lifted. Once the plank 130A has been partially lifted already, the entire length of the inner top side 136 of the toe portion of the blades engages the bottom side of the plank 130A evenly due to the arrangement of the inner top side 136 which comprises a level surface extending from the drum 126 to the end 138 of the blades.

The bottom side 134 of the blades 122 is formed with plural fulcrum points spaced therealong as described above in regard to the first embodiment. The tool 120 however additionally includes a first fulcrum 150 adjacent the end 138 of the toe portion of the blades for increased leverage when using the sharpened end 138 of the toe portion for lifting. Positioning the first fulcrum 150 adjacent the end 138 of the blades provides greater leverage due to the reduced distance of the fulcrum from the object to be lifted.

While various embodiments of the present invention have been described in the foregoing, it is to be understood that other embodiments are possible within the scope of the invention. The invention is to be considered limited solely by the scope of the appended claims.

What is claimed is:

1. A multipurpose tool comprising:

an elongate shaft having a gripping end and a working end; and a pair of elongate blades mounted on the working end of the shaft, parallel and spaced apart from one another, each blade having a toe portion extending from the shaft towards a first penetrating end and a heel portion extending from the shaft opposite the toe portion towards a second engaging end of the blade, a longitudinal axis of each blade extending from the first penetrating end to the second engaging end of the blade lying substantially perpendicularly to the shaft;

each blade having an inner side which comprises a level surface extending from the shaft and an outer side opposite the gripping end of the shaft which is formed to define at least one fulcrum located thereon between the first and second ends of the blade.

2. The tool according to claim 1 wherein the first penetrating end of each blade is tapered towards a cutting edge.

3. The tool according to claim 2 wherein the cutting edge is located in a plane which lies perpendicularly to the shaft.

4. The tool according to claim 1 wherein the second engaging end of each blade is tapered towards a blunt end face which is substantially parallel to the shaft.

5. The tool according to claim 1 wherein there is provided a plurality of fulcrums spaced longitudinally along the outer side of each blade between the first and second ends of the blade.

6. The tool according to claim 5 wherein the outer side of each blade comprises a plurality of substantially flat surfaces located sequentially along the blade with adjacent ones of the surfaces at an oblique angle to one another such that a fulcrum is defined at an intersection of each pair of adjacent surfaces.

7. The tool according to claim 1 wherein each blade comprises an elongate plate member which is parallel to the shaft.

8. The tool according to claim 1 wherein there is provided a fulcrum located between the blades, spaced inwardly from the outer side of the blades.

9. The tool according to claim 8 wherein an outer bottom face of the fulcrum located between the blades is spaced outwardly from and below the inner side of each blade.

10. A multipurpose tool comprising:

an elongate shaft having a gripping end and a working end; and a pair of elongate, spaced apart blades mounted transversely to the shaft on the working end thereof with the shaft therebetween, each blade comprising a plate member extending longitudinally from a first penetrating end to a second engaging end and being oriented such that the plate member lies parallel to the shaft with an outer side of the blade opposite the gripping end of the shaft;

wherein the working end of the shaft is formed to define a fulcrum located between the blades spaced between the first and second ends thereof;

one of the blades including at least one aperture therein in alignment with a corresponding aperture in the opposing blade.

11. The tool according to claim 10 wherein there is provided a plurality of longitudinally spaced apertures located in each blade, the apertures in one of the blades being aligned with corresponding apertures in the other blade.

12. The tool according to claim 1 wherein the shaft is mounted between the blades such that an inner side of each blade defines a shoulder adjacent a corresponding side of the shaft.

13. The tool according to claim 1 wherein a width of the penetrating end of each blade is less than a spacing between the pair of blades.

14. The tool according to claim 10 wherein the fulcrum located between the blades comprises a drum having an axis which lies perpendicularly to the shaft such that an outer face of the drum define the fulcrum.

15. The tool according to claim 14 wherein the drum is a tubular member having an opening at each end thereof in alignment with respective apertures in the blades defining a passage therethrough.

16. A multipurpose tool comprising:

an elongate shaft having a gripping end and a working end;

a pair of elongate blades mounted on the working end of the shaft, parallel and spaced apart from one another, transversely to the shaft, each blade having a toe portion extending from the shaft towards a first penetrating end and a heel portion extending from the shaft opposite the toe portion towards a second engaging end of the blade;

the blade having an outer side opposite the gripping end of the shaft which is formed to define at least one fulcrum located thereon between the first and second ends of the blade; and a flange member extending laterally outward from one of the blades, the flange member having at least one notch therein for use as a nail puller.

17. A multipurpose tool comprising:

an elongate shaft having a gripping end and a working end;

a pair of elongate blades mounted on the working end of the shaft, parallel and spaced apart from one another, transversely to the shaft, each blade having a toe portion extending from the shaft towards a first penetrating end and a heel portion extending from the shaft opposite the toe portion towards a second engaging end of the blade;

the blade having an outer side opposite the gripping end of the shaft which is formed to define at least one fulcrum located thereon between the first and second ends of the blade; and a serrated portion on an inner side of each blade, defining a gripping portion of each blade.

* * * * *